United States Patent [19]

Wilkens

[11] 4,380,913

[45] Apr. 26, 1983

[54] WEFT THREAD LAYING APPARATUS WITH COMBING ELEMENT

[75] Inventor: Christian Wilkens, Heusenstamm, Fed. Rep. of Germany

[73] Assignee: Karl Mayer Testilmaschinenfabrik GmbH, Obertshausen, Fed. Rep. of Germany

[21] Appl. No.: 258,773

[22] Filed: Apr. 29, 1981

[30] Foreign Application Priority Data

May 6, 1980 [DE] Fed. Rep. of Germany ..... 3017255

[51] Int. Cl.[3] ..... D04B 23/06

[52] U.S. Cl. ..... 66/84 A

[58] Field of Search ..... 66/84 A, 85 A, 84, 85

[56] References Cited

U.S. PATENT DOCUMENTS 3,744,276 7/1973 Hagel et al. ..... 66/84 A

*Primary Examiner*—Ronald Feldbaum

*Attorney, Agent, or Firm*—Omri M. Behr

[57] ABSTRACT

A weft thread magazine for a warp knitting machine has two endless transfer chains. The chains have holders for retaining weft threads in parallel and presenting them to a needle bed. Also included is a thread laying arrangement which transports the weft threads from one transfer chain to the other, and which is provided with a comb arrangement. The comb arrangement includes a comb element having at least one combing peg which is introduced between the weft threads proximate to one of the transfer chains and which moves parallel to the weft threads and is removed proximate to the other transfer chain. A carriage has a thread guide for guiding at least one weft thread into a position parallel to a previously laid weft thread. The comb element is carried on the end of the carriage directed toward the needle bed.

9 Claims, 5 Drawing Figures

WEFT THREAD LAYING APPARATUS WITH COMBING ELEMENT

BACKGROUND OF THE INVENTION

1. Field of the Invention

The present invention relates to weft thread inserting apparatus and, in particular, to a transversely movable, weft thread apparatus that carries both a thread guide and a combing element, thereby facilitating and simplifying the laying and combing of weft threads.

2. Discussion of the Relevant Art

In a known arrangement of this type (DE-PS No. 2063696) the thread laying arrangement comprises a continuous band running diagonally to the transport arrangement and having a combing element whose pegs intrude into the space between the weft threads. The speed of this band is geared to the speed of transport of the weft threads so that the movement of the pegs is effectively parallel relative to the direction of the weft threads. By means of these pegs, it is possible to separate weft threads which have become tangled because of mislaying between the transport chains or because of swinging which has occurred. Such tangling is a particular problem when dealing with "hairy" type of weft threads.

This combing arrangement is structurally quite complex, requiring a rather complicated drive arrangement with many gear wheels and chains. Furthermore, a substantial mass must be moved. Also, the guiding of the pegs is not very precise since the band is rather long, sags in the middle and tends to vibrate at certain machine speeds. As a consequence, the distance between neighboring weft threads cannot be less than a certain amount. Correspondingly, the wastage is particularly large at the turning points of the continuously fed weft thread at the transport chains.

Weft thread magazines without combing arrangements which include thread laying arrangements are well-known (DE-PS No. 2013694). Such thread laying arrangements include a carrier with at least one thread guide. This arrangement guides the appropriate weft threads parallel to the already laid weft threads between a holding means in one transfer chain to the other transfer chain. For this purpose a carriage, transversely movable between the transfer chains is provided into which a carrier may be mounted for reciprocation in the transfer (forward) direction. The carrier is steered by a guiding band which is connected to a steering arrangement. Both ends of the guiding band are longitudinally movable in the transfer direction, which enables the thread guides to continuously lay continuous weft threads between opposite holding means on a first and then a second chain, periodically displacing the threads by an appropriate number of holding elements on the outside of this second transfer chain and then completing the cycle by moving back in the opposite direction. By this means the weft threads may be continuously or endlessly laid. There are, however, thread guide arrangements which lay the thread merely from one transfer chain to the other whereupon they are cut. There are also thread laying arrangements in which the parallel movement of the thread guides with respect to the already laid threads is achieved in a different manner. For example, by altering the speed of the transfer chains in the vicinity of the thread laying arrangement.

SUMMARY OF THE INVENTION

Therefore it is one object of the present invention to provide a weft thread magazine having a relatively simple combing arrangement but which nevertheless provides a more accurate guiding of the combing pegs.

It is another object of the present invention to provide a combing element that moves parallel with respect to moving weft threads and is withdrawn before reaching the transfer chains holding such threads. It is yet another object of the present invention to provide a thread magazine capable of operating at high speed with closely spaced weft threads to reduce wastage and yet avoid tangling.

It is still another object of the present invention to mount a comb element on a transversely moving thread guide carrier to facilitate accurate combing since the carrier runs at the same level as the weft thread.

It is a further object of the present invention to mount a reciprocatable comb on the carrier that support the guides for the weft thread to reduce the moving mass and avoid the need for an independent power source for moving the comb.

A weft thread magazine for a warp knitting machine having a needle bed, according to the principles of the present invention, comprises, in combination, a pair of endless transfer chain means, each having a holding means. These holding means retain weft threads in parallel and present them to the needle bed. Also included is a thread laying arrangement for transporting weft thread from one of the pair of transfer means to the other. The thread laying arrangement includes a carriage means having at least one thread guide. The thread guide can guide at least one of the appropriate weft threads into a position parallel to an already laid weft threads. The magazine also includes a combing element mounted on the carriage means. The element has at least one combing peg and is operable to introduce the peg between weft threads proximate one of the pair of transfer chain means. The combing element is also operable to move its peg parallel to the weft threads and to remove the peg proximate the other transfer chain means.

BRIEF DESCRIPTION OF THE DRAWINGS

In order that the invention may be more fully understood, it will now be described, by way of example, with reference of the accompanying drawings in which.

DESCRIPTION OF THE PREFERRED EMBODIMENT

Figure 1:
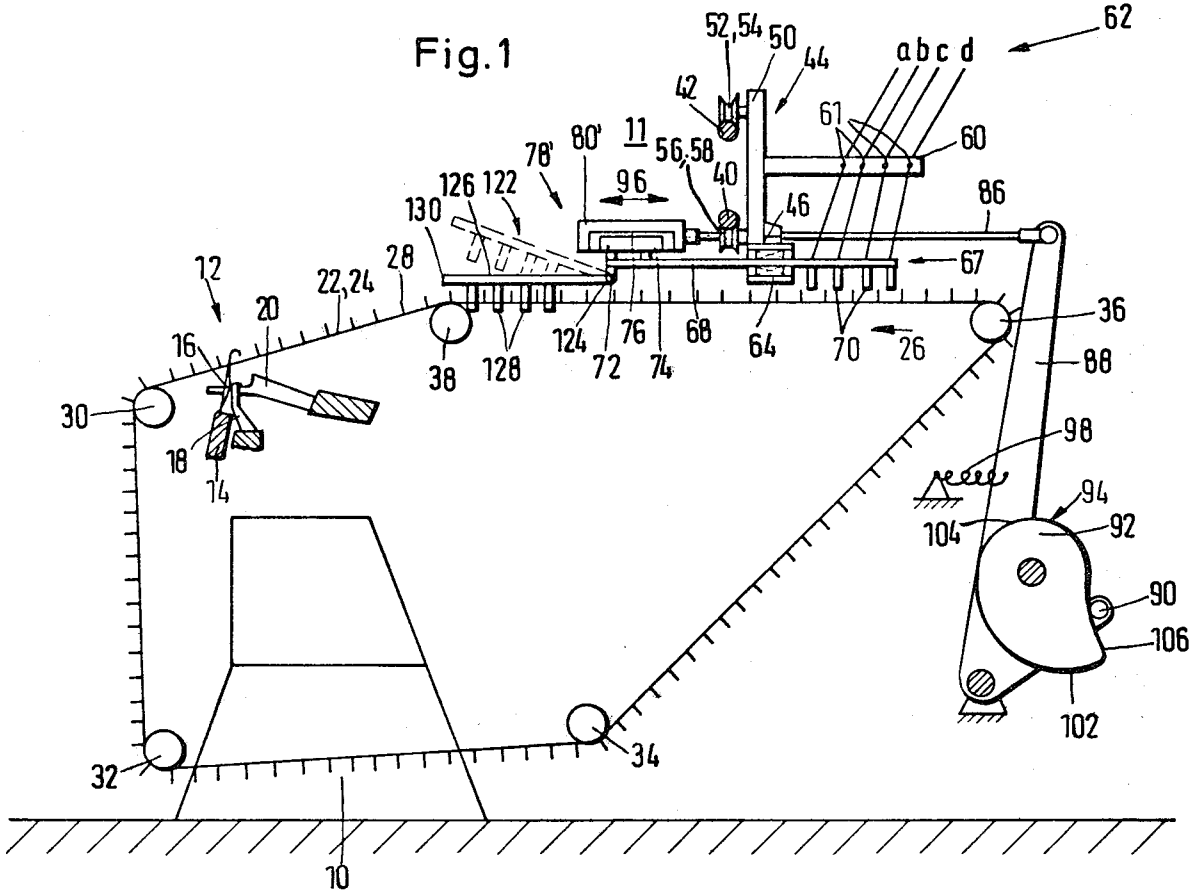
FIG. 1 is a schematic side view, partially in cross section, of a warp knitting machine equipped with the weft thread laying apparatus and combing apparatus, according to the principles of the present invention.

Referring now to the figures, and in particular to FIG. 1, this discloses a warp knitting machine 10 and weft thread magazine 11 of the instant invention. The warp knitting machine 10 includes a needle bed 12 which has a needle bar 14 having a plurality of hook needles 16 disposed, thereon in a conventional manner. The needles 16 cooperate with a slider mechanism 18 and a knockover sinker 20 all of which are a conventional design. On both ends of the needle bed 12 there is provided a pair of endless transfer chain means 22 and 24 which move in a longitudinal direction as shown by arrows 26 and 26'. The transfer chains are provided with a plurality of holding means 28 equally spaced and fixed to the transfer chains 22 and 24 in a conventional manner. The holding means are holders preferably having a pawn-like shape (a sphere disposed upon a truncated cone) and serve to hold the weft thread once it is wrapped therearound.

The transfer chains are endless and are led over a plurality of rollers 30, 32, 34, 36 and 38 of which at least one is connected to a source of driving power, not shown. In the transverse direction (perpendicular to the transfer chains) a pair of support rails 40 and 42 are disposed one above the other. A carriage means including carriage 44 is driven forward and backward in a conventional manner, by means of a chain 46, belt or the like, as shown by arrow 48 in FIG. 2.

Figure 2:
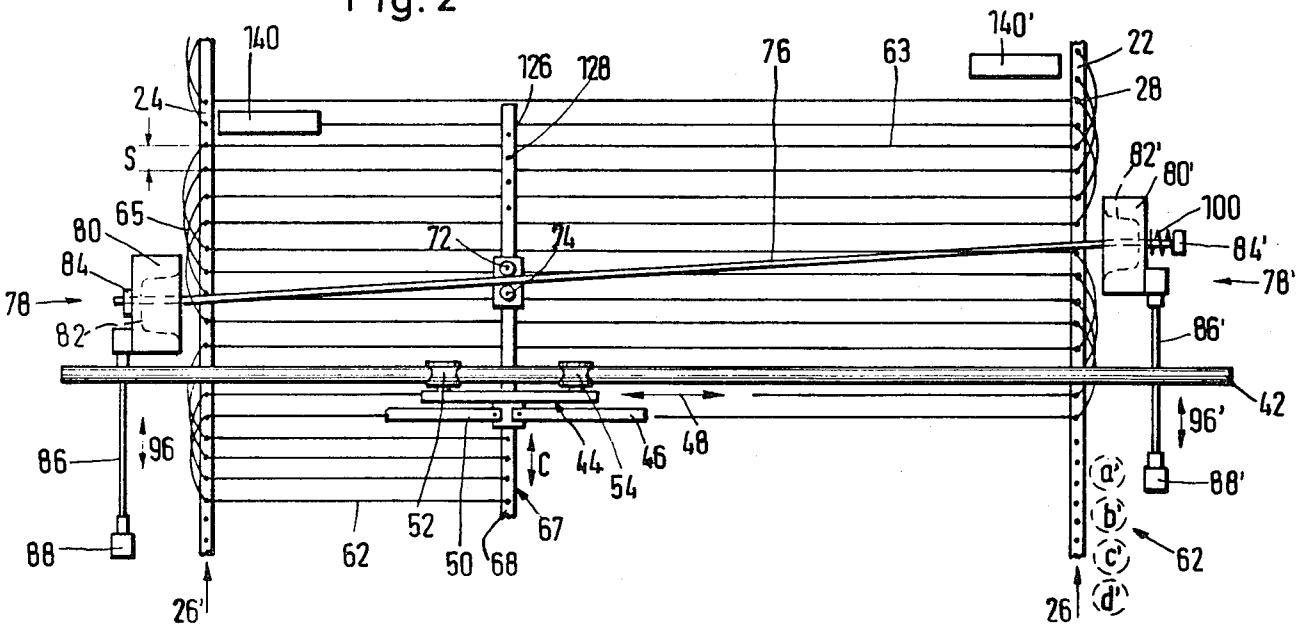
FIG. 2 is a plan view of the needle bed of the machine shown in FIG. 1 from a weft thread pick-up area to the delivery area proximate the needle bed showing the thread laying and combing devices.

A thread laying arrangement employs the carriage means 44 which includes a frame 50 (FIGS. 1 and 2) and a pair of rollers or wheels 52 and 54 journaled in the upper portion of frame 50, in a conventional manner and a pair of rollers or wheels 56 and 58 as journaled on the lower portion of the frame in the same manner. The rollers 52 and 54 are adapted to ride on the support rail 42 and the rollers 56 and 58 are adapted to ride on the support rail 40, permitting the carriage 44 to move in a transverse direction freely thereon. The carriage 44 is also provided with an upper thread guide 60 which is provided with a plurality of apertures 61 therein through which the weft threads 62 *a,b,c* and *d* are threaded. Preferably, the lower portion of the carriage frame 50 is provided with an axial bearing shown herein as a bushing 64 having an aperture therein which is adapted to slidably receive guide rod 68 of carrier 67 herein (FIGS. 1 and 2). One end of guide rod 68 is provided with a plurality of thread guides 70 disposed thereon, in a conventional manner and the other end of rod 68 is provided with a pair of rollers 72 and 74 journaled thereon. The rollers 72 and 74 are located on both sides of a flexible guide band 76 preferably made of steel. The guide rod 68 is permitted to freely move within the aperture of bushing 64 and its movement thereof is obviously controlled by the position of rollers 72 and 74.

One end of the flexible guide band 76 is preferably rigidly connected to a steering means 78 which is provided with a housing 80 having an opening 82 therein adapted to receive rollers 72 and 74 therein, as well as retain band 76 by means of a nut 84 provided therefore. The steering apparatus 78 has its housing 80 coupled by means of a rod 86 and a lever 88 articulated therewith. The lever 88 is provided with a contact roller 90 journalled thereon which continually cooperates with a driven cam 92 having a curved surface 94 which cooperates with roller 90 thereby moving lever 88 and rod 86 in the direction of arrow 96 which is in the longitudinal direction. A spring 98 maintains tension on lever 88 so that contact roller 90 faithfully follows the surface 94 of cam 92.

On the opposite end of the needle bed proximate transfer chain 22 a second steering apparatus 78' is provided. Steering apparatus 78' includes a housing 80' which is provided with an aperture 82' and is driven in the direction of arrow 96' by rod 86', lever 88' and a contact roller and cam arrangement, not shown, similar to the driving arrangement shown with regard to the steering apparatus 78. The band 76 is retained in the housing 80' by means of nut 84' and is also provided with a spring device 100 disposed between the nut and rear surface of the housing so that by tightening or loosening the nut 84; the tension of the flexible guide band 76 may be adjusted.

As shown in FIGS. 1 and 2 the weft threads 62 *a,b,c* and *d* are taken from spools 62 *a',b',c'* and *d'* (see FIG. 2) and threaded through upper thread guide 60 and then through thread guides 70 and by means of the movement of the carriage 44 and guide 70 the weft threads 62 are wrapped around the holding devices 28 on the transfer chains. The weft threads 62 are moved rearwardly in the direction of arrow 96 when they find themselves outside of the transfer chains 22 and 24 and this rearward longitudinal movement is repeated each time the carriage is moved in the area of transfer chain 22 and then in the area of transfer chain 24, as explained hereinafter.

Preferably, holding devices 28 are spaced so that the distance S (FIG. 2) between adjacent holding elements 28 is no closer than 8 millimeters. Consequently, the length of thread elements 65 which are located on the outside of holders 28 (and are illustrated merely schematically) and which are later cut away, are kept extraordinarily short, thus, of course, resulting in saving of thread material.

Figure 3:
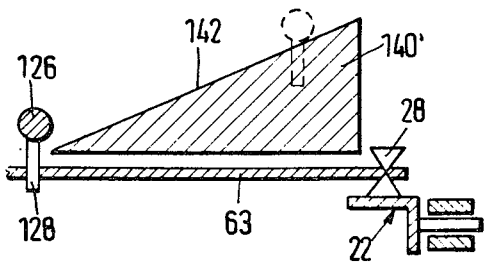
FIG. 3 is a sectional view of the wedge and adjacent elements of FIG. 1.

In the embodiment of FIGS. 1 through 3, a combing element 122 is located at that end of carrier 67 directed towards needle bed 12. Combing element 122 is attached to carrier 67 by hinge means 124 whose axis runs perpendicular to transfer chains 22 and 24, allowing free end 130 to lift. Element 122 comprises a cylindrical holder 126 provided with a plurality of downwardly directed pegs 128 which are sized and shaped to separate neighboring weft threads 63. Four pegs 128 are shown, it being preferable that the number be at least as great as the number of thread guides 70. As indicated in phantom in FIG. 1 the free end of holder 126 can be swung upwardly so that pegs 28 are removable from the spaces between the threads.

For this purpose, wedge member 140 and 140', shaped as solid triangular prisms, are provided on both sides of the machine: on the inside of and proximate to said chain 24 and 22, respectively. Each wedge has an inclined surface over which the free end 130 of holder 126 can ride. The inclined surface of wedge 140 is shown in FIG. 3 as surface 142, it being understood that the side view of wedge 140' is similar and is the mirror image thereof. In a manner not illustrated in the drawings, wedge 140 is connected with housing 80 and wedge 140' with housing 80'. Consequently, wedges 140 and 140' move in unison with housings 80 and 80' so that the contact of the holder 126 on the incline is maintained even when the carrier is displaced backwards in the manner described hereinafter.

Inasmuch as combing element 122 is advantageously attached to a free end of the thread guide carrier 67 that protrudes from axial bearing 64, combing element 122 requires extremely little additional power. Also, since rod 68 of carrier 67 carries thread guide 70 on one side of its axial bearing 64, and on the other side, combing element 122 as well as rollers 72, 74, forces act substantially equally on both sides of bearings 64 and the load on rod 68 can be advantageously balanced. Also, as a result of the foregoing construction, weft threads can be spaced 8 millimeters or less. This close spacing is possible because combing element 122 is precisely positioned with respect to the weft threads to prevent tangling before they reach needle bed 12. As a consequence of this minimal separation, there is very small wastage at the turnaround points.

In operation, transfer chains 22 and 24 are driven in a forward or longitudinal direction as shown by arrows 26 and 26'. Carriage 44 is moved in the direction of arrow 48 by means of a reciprocating drive arrangement 46 whereby it is made to come to rest for a short period of time at the end of travel of the carriage which occurs when rollers 72 and 74 are positioned in the housing 80' where the rearward movement is timed to take place. The carriage is then moved in a longitudinal direction as shown by arrow 96 when the steel band 76 is moved backwards and forwards by the steering apparatus which is coupled to cam 92, via rod 86 and via rod 88, as explained earlier. The rearward movement is adjusted to move the thread guides 70 a distance of four holding devices 28 as determined by the cam surface 94 on cam 92. As the carriage 44 starts to move towards the left, as shown in FIG. 2, a small forward movement of thread guide 70 occurs because of the segment 102 of cam 92. This movement comes to a complete halt as the cam portion 104 comes into contact with contact roller 90. This occurs when the carrier 44 is located inside of the transfer chains 22 and 24. When the carriage finds itself outside of the transfer chains 22 and 24 cam segment or portion 106 causes the linkage 86 and 88 to move the thread guide 70 sharply in a rearward direction thereby permitting the thread to move past the holding devices 28 on transfer chains 22 or 24 and the wrap around is completed as the carriage then returns towards the opposite transfer chain.

As carriage 44 transversely reciprocates as indicated by arrow 48, it lays weft threads 63 across opposite holders 28 on chains 22,24. For the condition shown in FIG. 2, carrier 67 and holder 126 are moving parallel to weft threads 63, pegs 156 having been inserted between threads 63 to comb and separate them. Since rollers 72 and 74 move rod 68 forward at the same speed as weft threads 63, comb element 122 moves parallel but not against weft threads 63. As comb element 122 moves towards the right (FIG. 2), eventually free end 130 of holder 126 reaches wedge 140' and rides upwardly across inclined surface 142 (FIG. 3) thereby lifting pegs 128 from between weft threads 63. At this time, rollers 72 and 74 enter cavity 82' of housing 80'. Thereafter, housing 80' is moved backwardly as described above. However, since wedge 140' is supported by housing 80', holder 126 and wedge 140' move together so that free end 130 does not fall from inclined surface 142. After housing 80' completes this retrograde motion, wrapping weft threads 63 around holding devices 28, carriage 44 progresses in the opposite direction, that is, to the left in FIG. 2. As a result, free end 130 of holder 126 descends the inclined surface 142 of wedge 140'. Accordingly, pegs 128 are reinserted between weft threads 63 after clearing chain 22. The combing element 122 proceeds toward housing 80 which eventually causes wedge 140 to lift holder 126 in a manner similar to that previously described for wedge 140'.

It will be appreciated that since combing element 122 combs and separates weft threads 63 just prior to their entry into needle bed 12, the spacing between weft threads can be kept small and tangling is unlikely even at relatively high machine speeds. Also, since carrier 67 carries both thread guides 70 and combing element 122 the complexity of construction is reduced considerably. The mass which has to be moved is also correspondingly less. Furthermore, there is no requirement for a separate drive means for combing arrangement 122. Also, because the combing arrangement possesses the same precision of guidance as thread guide 70, undesireable changes in the height orientation of pegs 128 are unlikely since carrier 67 runs at the exact height without swinging.

Figure 5:
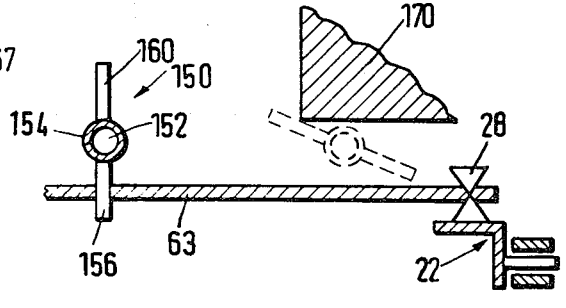
FIG. 5 is a sectional view of the combing element of FIG. 4 showing its operation.
Figure 4:
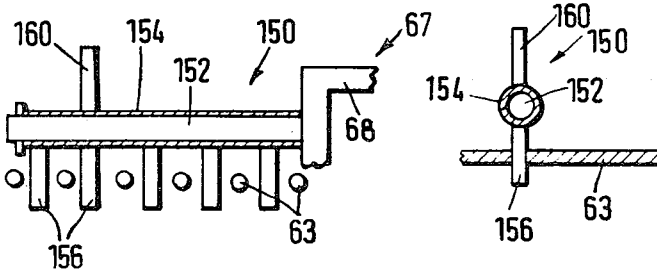
FIG. 4 is a sectional side view of a combing element which is an alternate to that shown in FIG. 1.

A further embodiment is illustrated in FIGS. 4 and 5. In this embodiment, an alternate comb element 150 is provided at the end of rod 68 of carrier 67. The element comprises an axle 152 bracketed onto a downward tab of rod 68. Axle 152 is inserted into rotatable housing 154 which is a sleeve sized to fit axle 152 without binding. On the underside of housing 154 are provided pegs 156 which serve to separate weft threads 63. Housing 154 is arranged so that upon its rotation about an axis parallel to transfer chains 22, 24, pegs 156 lift from the level of weft threads 63. On the other side of housing 154 there is provided a striker arm 160 in the form of a cylindrical rod. Since the combined weight of pegs 156 will exceed that of striker arm 160, a normal orientation due to gravity will be as illustrated in FIG. 4. If desired, however, this normal orientation can be urged by the provision of a suitable biasing spring element (which is not illustrated). On both sides of the machine (in the same positions as wedges 140 and 140') there are located striker plates as follows: a striker plate 170 located at chain 22 (FIG. 5) it being appreciated that positioned at chain 24 is another striker plate (not illustrated) similar to plate 170 and configured as the mirror image thereof.

Striker arm 160, extending in the opposite direction from pegs 156, is sized to contact striker plate 170 proximate to transfer chain 22. This and the complimentary striker plate are so positioned that pegs 156 disengage the weft threads before reaching the chains 22, 24 irrespective of the direction of movement. Such disengagement at the end of transverse motion is shown in phantom in FIG. 5 wherein striker bar 160 contacts striker plate 170, causing housing 154 to rotate and remove pegs 156 from contact with weft threads 63

For the embodiment of FIGS. 4 and 5, the operation of comb element 150 is similar to that previously described except that instead of lifting, pegs 156 rotate upwardly out of engagement with weft threads 63 when the striker arm 160 engages striker plate 170, as illustrated in phantom in FIG. 5. Again, striker plate 170, may if desired be coupled to housing 80' to move in unison with comb element 150 so that striker arm 160 does not disengage striker plate 170 when housing 80' retrogresses carriage 44, at the extreme end of its travel.

It will be appreciated that various modifications to the foregoing embodiments are possible in light of the above teachings. For example, in another embodiment the combing pegs may be attached to a holder which is mounted about an axis perpendicular to the forwarding direction and, in the vicinity of the forwarding chains 22, 24, this holder is caused to run up the incline of a wedge by which means the pegs are similarly removed from the level of the weft threads. Also, in order to ensure greater security against rotation of carrier 67 about its axis, it can be suitably locked or keyed into radial bearing 64. Alternatively, carrier 67 can be constructed from a pair of rods connected to each other and each set into radial bearing 64. On the other hand, two radial bearings can be utilized to achieve the same function.

Hereinbefore has been disclosed an efficient device for installing and combing weft threads in warp knitting capable of operating at relatively high speeds without tangling. It will be understood that various changes in the details, materials, arrangement of parts and operating conditions which have been herein described and illustrated in order to explain the nature of the invention may be made by those skilled in the art within the principles and scope of the instant invention.

Having set forth the nature of the invention, what is claimed is:

1. A weft thread magazine for a warp knitting machine having a needle bed, said magazine comprising, in combination:

(a) a pair of endless transfer chain means each having holding means for retaining weft threads in parallel and for presenting them to said needle bed;

(b) a thread laying arrangement for transporting weft threads from one of said pair of transfer means to the other, said arrangement including a carriage means having at least one thread guide for guiding at least one of the appropriate weft threads into a position parallel to an already laid weft thread; and (c) a combing element mounted on said carriage means and having at least one combing peg and being operable to introduce said peg between weft threads proximate one of said pair of transfer chain means, to move said peg parallel to the weft threads and to remove said peg proximate the other transfer chain means.

2. A weft thread magazine according to claim 1 wherein said combing element is mounted on a portion of said carriage means directed toward said needle bed.

3. A weft thread magazine according to claim 2 wherein said carriage means has a plurality of thread guides and wherein said combing element has a plurality of combing pegs equaling in number said plurality of thread guides.

4. A weft thread magazine according to claim 2 wherein said carriage means is transversely movable between said pair of chain means, said carriage means comprising:

(a) a carrier having a free end and being slidably mounted in said carriage means, said combing element being attached to said free end of said carrier;

(b) a guide band transversely disposed across said pair of chain means;

(c) a steering means attached to opposite ends of said band for positioning it.

5. A weft thread magazine according to claim 4 wherein said carriage means includes a bearing into which said carrier is journaled.

6. A weft thread magazine according to claim 5 wherein said carrier comprises:

(a) a rod journaled in said bearing; and (b) a pair of rollers mounted on said rod for engaging said guide band, said rod supporting said thread guide on one side of said bearing and on its other side said rollers and said combing element.

7. A weft magazine according to claim 1,2,4 or 6 wherein said combing element includes an outwardly projecting striker arm, said combing peg and arm being mounted for rotation about an axis parallel to said chain means, said magazine including a pair of striker plates each disposed proximate a different respective one of said pair of chain means for engaging said arm and rotating said peg.

8. A weft magazine according to claims 1,2,4 or 6 wherein said combing element includes a peg holder hingeably mounted to rotate about an axis perpendicular to said chain means, said magazine including a pair of wedge members each disposed proximate a different respective one of said pair of chain means for engaging and rotating said holder.

9. A weft magazine according to claim 1 wherein said thread laying arrangement is operable to lay threads in an endless manner, said holding means comprising a plurality of holders spaced less than eight millimeters apart.

* * * * *